United States Patent [19]

Pendergrass

[11] Patent Number: 4,574,217

[45] Date of Patent: Mar. 4, 1986

[54] INCANDESCENT LAMP AND BASE

[75] Inventor: Edward A. Pendergrass, Mentor, Ohio

[73] Assignee: General Electric Company, Schenectady, N.Y.

[21] Appl. No.: 466,284

[22] Filed: Feb. 14, 1983

[51] Int. Cl.[4] ..... H01K 1/50

[52] U.S. Cl. ..... 313/579; 313/316; 313/318

[58] Field of Search ..... 313/318, 579, 325, 315, 313/316, 569; 339/144 T

[56] References Cited

U.S. PATENT DOCUMENTS

| | | | |
|---|---|---|---|
| 3,356,984 | 12/1967 | Thorington et al. | 313/318 |
| 3,852,631 | 12/1974 | Evans | 313/318 |
| 4,033,776 | 7/1977 | Golya et al. | 501/15 |
| 4,084,112 | 4/1978 | Herbert et al. | 313/318 |
| 4,100,448 | 7/1978 | Chipner et al. | 313/318 |
| 4,126,810 | 11/1978 | Cox | 313/318 |
| 4,238,705 | 12/1980 | Thomas | 313/579 |
| 4,287,448 | 9/1981 | Bradley | 313/318 |
| 4,499,404 | 2/1985 | Walsh | 313/579 |

*Primary Examiner*—David K. Moore

*Attorney, Agent, or Firm*—John F. McDevitt; Philip L. Schlamp; Fred Jacob

[57] ABSTRACT

An electrically insulative base for an incandescent lamp is disclosed having a three-part construction with all of the individual base parts being joined together in butt-seal engagement along a pair of horizontal planes parallel to each other and transverse to the longitudinal lamp axis. Said base construction is especially useful in the tungsten halogen cycle lamps of the high wattage type requiring that a ceramic material be used and whereby the ceramic base parts are joined together before lamp assembly with a ceramic sealing material.

3 Claims, 2 Drawing Figures

INCANDESCENT LAMP AND BASE

RELATED APPLICATION

In allowed U.S. Patent Application Ser. No. 405,650, filed Aug. 5, 1982, which is now U.S. Pat. No. 4,499,404 and assigned to the assignee of the present invention, there is described a related two-part base construction wherein the base parts are joined together in butt-seal engagement along a horizontal plane transverse to the longitudinal lamp axis. The present invention represents an inprovement thereon whereby said base parts are spaced apart with an intermediate base part for joinder together in the same general relationship a butt-sealed engagement.

BACKGROUND OF THE INVENTION

Two-part base construction for incandescent lamps is known such as disclosed in U.S. Pat. No. 3,852,631, assigned to the assignee of the present invention. In said prior art base constructions, the individual base parts have been formed in two half sections made of insulating material and which are joined together generally with external fastening means along the longitudinal lamp axis. While this type base construction facilitates ease of assembly during lamp manufacture, the length of the base parts formed in half sections often leads to physical distortion when these parts are manufactured as well as poor registration between the half sections during lamp manufacture.

The above indicated problems with two-part lamp base constructions are increasingly severe when the base is constructed with a ceramic material. More particularly, the firing of a ceramic material increases physical distortion so that controlling physical dimensions of a half section base part becomes increasingly difficult and which can lead to failure of the half sections to meet properly when joined together. The advantages of two-part base constructions are thereby largely lost when a ceramic material is required and which has resulted in use of a single base member requiring that a central cavity be machined in said member to physically support the vitreous lamp envelope.

The aforementioned difficulties are reduced with the two-part base construction described in the above referenced Ser. No. 405,650 application. As therein described, the central cavity in this base construction is formed without machining when the two base parts have been assembled together and physical dimensions are better controlled. On the other hand, such improved dimensional control again becomes difficult with increased size of the base member especially in the direction of the lamp longitudinal axis. This problem is particularly severe when the base member is fabricated with ceramic material since the distortion occurring during the firing cycle often produces an open joint at the butt-sealed intersection. Poor dimensional control or distortion of the ceramic lamp base can also seriously impede efforts to "prefocus" the lamp filament during manufacture. Specifically, it is often desirable to accurately position said filament in the final lamp assembly along the longitudinal lamp axis by a predetermined distance. This objective can be achieved far more reliably with precise dimensional control of the ceramic lamp base in a manner hereinafter more fully described. It would be desirable, therefore, to further reduce this overall problem again in a manner not requiring undue modification or additional cost in either lamp or lamp base manufacture.

SUMMARY OF THE INVENTION

A novel three-part base construction for an incandescent lamp has now been discovered which provided the central cavity without machining when the three base parts have been assembled together and is less subject to all of the aforementioned dimensional problems. More particularly, the improved three-part base for said type lamp is formed of an electrically insulated material joined together in butt-seal engagement along horizontal planes parallel to each other and transverse to the longitudinal lamp axis with an upper base part having a central cavity opening in which the press seal end of the lamp is supported and a lower base part having a passageway for a pair of electrical conductors connected to the lamp inleads, said base parts being spaced apart and joined together with an intermediate base part also containing a passageway for said pair of electrical conductors. In a preferred embodiment, said improved base is formed of ceramic material with all base parts being joined together with ceramic sealing material before final lamp assembly. A representative incandescent lamp utilizing the presently improved three-part base construction thereby comprises:

(a) A transparent vitreous envelope containing a resistive incandescent filament connected to a pair of conductive inleads hermetically sealed to the vitreous envelope in a press seal region at one end of said envelope;

(b) externally extending termination conductors secured to said lamp inleads to provide electrical current to said lamp; and (c) a three-part base for said lamp formed of electrically insulative material joined together in butt-seal engagement along horizontal planes transverse to the longitudinal lamp axis with an upper base part having a central cavity opening in which the press seal end of said lamp is supported and a lower base part which contains a passageway for said externally extending termination conductors, said base parts being spaced apart with an intermediate base part also containing a passageway for said externally extending termination conductors.

In a preferred lamp embodiment, the vitreous envelope is glass and refractory metal inleads are employed, generally tungsten metal, which are further joined to larger diameter termination conductors disposed in the lamp base.

The principal advantages of the present three-part base construction are best illustrated in tungsten halogen cycle type incandescent lamps of relatively high wattage requiring that the lamp base be constructed with a ceramic material to provide the required strength, thermal endurance and electrical insulative properties for lamp operation over extended time periods. This type incandescent lamp has widespread use in studio, theater, and television lighting applications. The high wattage rating of such lamps, up to around 2,000 watts, has required that the ceramic base construction be of a relatively heavy nature to provide adequate physical support for a relatively large size lamp envelope containing a multifilament, resistive element and associated mount and with a further metal base shell being secured to said ceramic base serving as structural means to optically focus the lamp filament. In said latter type lamp embodiment, a two-piece metal base construction can be employed having an inner shell member directly bonded to the exterior surface of the lower ceramic base part and which is inserted into an outer shell member for a predetermined distance related to the optical focus of said lamp filament. A typical lamp of this general type incorporating the presently improved part ceramic base comprises:

(a) a transparent vitreous envelope containing a resistive tungsten filament connected to a pair of refractory metal inleads hermetically sealed to the vitreous envelope in a press seal region at one end of said envelope;

(b) externally extending termination conductors secured to said lamp inleads to provide electrical current to said lamp;

(c) an inert gas filling within said vitreous envelope which contains sufficient halogen to produce the halogen cycle during lamp operation;

(d) wherein the improvement comprises having three base parts sealed together in butt-seal engagement along a horizontal plane transverse to the longitudinal lamp axis by means of ceramic sealing material, said ceramic base comprising an upper base part having a central cavity opening in which the press seal end of said lamp is supported and a lower base part which contains a passageway for said externally extending termination conductors, said base parts being spaced apart with an intermediate base part also containing a passageway for said externally extending termination conductors; and (e) ceramic sealing material being disposed in the central cavity of said upper base part to secure the press seal end of said lamp in said cavity.

As will be further explained in connection with the hereinafter preferred embodiment for said lamp construction, the ceramic sealing material that is disposed in the central cavity of said improved lamp base member provides substantial physical support to the lamp envelope end inserted into the central cavity by reason of the free space not being occupied by said lamp envelope end. In the manufacture of a final lamp assembly utilizing said above defined lamp and base construction, there is subsequently assembled to the lower base part of the ceramic base member, an inner metal base shell by conventional bonding means, such as a lamp having cement. Said inner base shell is then inserted into an outer metal base shell to a depth establishing a predetermined distance between the center of the lamp filament along the longitudinal lamp axis and a reference or datum plane established with further structure of said outer base shell. For example, mounting a flange element provided on said outer metal base shell can be used as the means to locate the filament a predetermined fixed distance therefrom in said final lamp assembly whereupon each lamp assembly manufactured in such manner will have the same focal point when installed in a lamp fixture. By such prefocusing means, there is avoided any need to refocus a replacement lamp assembly when employed for such end product applications as studio lighting, spotlights, and the like.

DETAILED DESCRIPTION OF THE PREFERRED EMBODIMENT

Figure 1:
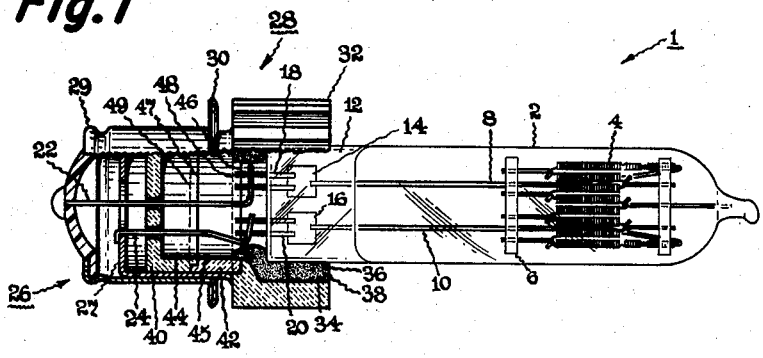
FIG. 1 is a plan view of a tungsten halogen cycle lamp produced in accordance with the invention.

Referring to FIG. 1, a representative tungsten-halogen cycle lamp 1 corresponding to a 1,000 watt, 120-volt size is illustrated which comprises a vitreous quartz glass envelope 2 of tubular form that encloses a multifilament incandescent lamp coil 4 which is suspended from a conventional filament mount 6. A pair of refractory metal inleads 8 and 10 provides the means of furnishing electrical energy to said filament coil which are hermetically sealed at one end of the tubular-shaped lamp glass envelope by a direct vacuum-type pinch seal 12 and with the opposite ends of said lead-in wires being joined to conventional foil elements 14 and 16, respectively, to insure that vacuum-type sealing takes place. There is further provided in the press seal region two pair of larger diameter inlead wires 18 and 20 that are fixed to each of said foil elements to form part of the physical support structure of said lamp and which need not necessarily be hermetically sealed in the lamp construction. Said pair of larger diameter inlead wires are fixed at the opposite end to an externally extending pair of termination conductors 22 and 24, respectively, which are electrically connected in the conventional manner to a two-piece metal base construction 26. An inner base shell 27 secured to the ceramic base member 28 of the present invention engages an outer base shell 29 having a flange element 30. Said ceramic base member 28 is of a three-part construction with upper part 32 including a central cavity opening 34 in which the press seal end 12 of said lamp is disposed allowing a free space 36 to remain in said cavity which is thereafter filled with ceramic sealing material 38 to secure the lamp envelope in the assembled base member along with providing substantial physical support to the lamp envelope in the assembled lamp. Lower ceramic base part 40 is spaced apart from said upper base part 32 by engagement with intermediate base part 42, and with both of said latter base parts having longitudinal passageways 44 and 45, respectively, which extend entirely therethrough for emergence of the termination conductors. The assembled base parts are shown to be joined together at parting lines 46 and 47 and which further depicts the butt-seal engagement therebetween shown in phantom relief at 48 and 49, respectively.

Figure 2:
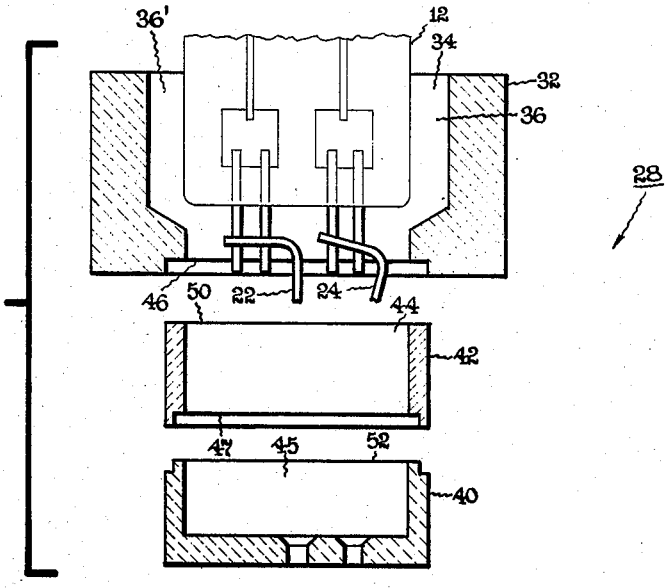
FIG. 2 is a more detailed plan view of the three-part base member employed in the FIG. 1 lamp embodiment before said parts have been assembled together.

In FIG. 2 there is shown in plan view the unassembled upper, lower and intermediate base parts 32, 40 and 42, respectively, of the above described base member 28 in the FIG. 1 lamp embodiment. Said upper base part 32 includes the central cavity 34 which supports pressed seal end 12 of the lamp when disposed therein and which has been shown for illustration purposes in perspective relief. A free space 36 and 36' exists on either side of said lamp envelope end after insertion into said cavity to enable ceramic sealing material (not shown) to be disposed in this free space during the final lamp assembly. Said ceramic material not only secures the lamp envelope to the assembled base in said manner but generally also flows downwardly into the central passageway area 44 of the intermediate base part 42 to electrically insulate the externally extending termination conductors 22 and 24 as well. As can be noted, intermediate base part 42 includes top sealing rim 50 for butt-seal engagement with said upper base part at parting line 46 when these two parts are joined together, preferably before final lamp assembly, with a ceramic sealing material (not shown). Correspondingly, lower base part 40 includes central passageway 45 and engages said intermediate base part 42 at parting line 47 with its top sealing rim 52. As can be further noted, such assembly of the three-part base occurs in a pair of horizontal planes transverse to the lamp longitudinal axis and with physical registration between said base parts being provided with grooved portions located at the bottom edges of the upper and intermediate base parts. It is preferred that said base parts be all joined together with ceramic sealing material which can be carried out in a single firing operation used to sinter the ceramic base parts in order to reduce the number of processing steps in lamp manufacture. As previously indicated, the two-piece metal base shell construction illustrated for said lamp embodiment can thereafter be secured to the assembled ceramic base after assembly of the lamp member thereto, all in a conventional manner to complete the final lamp manufacture.

It will be apparent from the foregoing description that an improved three-part lamp base for incandescent lamps has been disclosed which is generally useful. It will be further apparent to those skilled in the lamp art, however, that said improved incandescent lamp base can be used with other type incandescent lamps other than above specifically described. For example, tungsten halogen lamps having a different configuration are finding increasing use at sufficiently elevated wattages to require a ceramic base material such as in vehicle and outdoor lighting applications. Accordingly, it is intended to limit the present invention only by the scope of the following claims.

What I claim as new and desire to secure by United States Letters Patent is:

1. A tungsten halogen cycle lamp of the relatively high voltage type with a three-part electrically insulated ceramic base which comprises:

(a) a transparent vitreous envelope containing a multi-filament incandescent lamp coil suspended from a filament mount and connected to a pair of refractory metal inleads hermetically sealed to the vitreous envelope in a press seal region at one end of said envelope;

(b) externally extending termination conductors secured to said lamp inleads to provide electrical current to said lamp;

(c) an inert gas filling within said vitreous envelope which contains sufficient halogen to produce the halogen cycle during lamp operation;

(d) wherein the improvement comprises having all three base parts sealed together in butt-sealed engagement along a horizontal plane transverse to the longitudinal lamp axis by means of ceramic sealing material, said ceramic base comprising an upper base part having a central cavity opening in which the press seal end of said lamp is supported and a lower base part which contains a passageway for said externally extending termination conductors, said base parts being spaced apart with an intermediate base part also containing a passageway for said externally extending termination conductors;

(e) ceramic sealing material being disposed in the central cavity of said upper base part to secure the press seal end of said lamp in said cavity; and (f) a two-part metal base shell secured to said ceramic base which serves as a means to optically focus the lamp filament, said metal base shell having an inner shell member directly bonded to the exterior surface of said ceramic base part which is inserted into an outer shell member for a predetermined distance related to the optical focus of said lamp filament, and with said externally extending termination conductors protruding from the lower base part of said ceramic base and being electrically connected to said metal base shell.

2. A lamp as in claim 1 wherein the vitreous envelope is quartz glass and the refractory metal inleads are wires joined to larger diameter inlead wires in the press seal region of said glass envelope.

3. A lamp as in claim 1 wherein the central cavity opening of the lamp base is substantially greater than the space occupied by the press seal end of said lamp and the ceramic sealing material in said cavity provides physical support of the assembled components.

* * * * *